US010856669B2

(12) United States Patent
Lin et al.

(10) Patent No.: US 10,856,669 B2
(45) Date of Patent: Dec. 8, 2020

(54) PROTECTIVE COVER FOR OUTDOOR APPARATUS

(71) Applicant: OUTER, INC., Los Angeles, CA (US)

(72) Inventors: Terry Kang Lin, Los Angeles, CA (US); Jiake Liu, Los Angeles, CA (US); Patrick Ryan, Los Angeles, CA (US)

(73) Assignee: OUTER, INC., Los Angeles, CA (US)

( * ) Notice: Subject to any disclaimer, the term of this patent is extended or adjusted under 35 U.S.C. 154(b) by 0 days.

(21) Appl. No.: 16/750,305

(22) Filed: Jan. 23, 2020

(65) Prior Publication Data

US 2020/0154903 A1 May 21, 2020

Related U.S. Application Data

(63) Continuation of application No. PCT/US2019/032299, filed on May 14, 2019.

(60) Provisional application No. 62/671,347, filed on May 14, 2018.

(51) Int. Cl.
*A47C 1/14* (2006.01)
*A47C 31/11* (2006.01)

(52) U.S. Cl.
CPC ..... *A47C 31/113* (2013.01); *A47C 1/14* (2013.01)

(58) Field of Classification Search
CPC ..... A47C 31/113; A47C 31/003; A47C 31/02; A47C 31/023; A47C 31/04; A47C 31/10; A47C 31/11; A47C 1/14; A47C 4/028; A47C 4/06; A47C 4/30; A47C 7/021; A47C 7/22; A47C 7/24; A47C 7/62; A47C 7/66; B60N 2/70; B60N 2/58; B60N 2/60; B60N 2/6009; B60N 2/6018; B60N 2/6036
USPC ..... 297/228.13
See application file for complete search history.

(56) References Cited

U.S. PATENT DOCUMENTS 3,310,091 A * 3/1967 Geisen ..... A47G 11/004 108/90
4,118,066 A * 10/1978 Ricke ..... B60J 11/025 296/136.03
4,600,238 A * 7/1986 Goodford ..... B60N 2/6027 297/219.1
5,829,828 A * 11/1998 Asfaw ..... A47C 31/11 297/219.1
6,158,805 A * 12/2000 Blaney ..... B60N 2/24 135/88.09
6,382,720 B1 * 5/2002 Franklin ..... B60N 2/6027 297/221

(Continued)

FOREIGN PATENT DOCUMENTS

WO 2019089679 A1 † 5/2019

*Primary Examiner* — Mark R Wendell
(74) *Attorney, Agent, or Firm* — Nixon Peabody LLP; Matthew T. Kitces

(57) ABSTRACT

The present disclosure provides for a protective covering, which includes a cover portion, an elongated piece of fabric, a first coupling mechanism, and a second coupling mechanism. The cover portion is for a seat cushion. The elongated piece of fabric extends from the cover portion. The first coupling mechanism couples the cover portion to a first end of the elongated piece of fabric. The second coupling mechanism is configured to couple the cover portion to a second end of the elongated piece of fabric.

20 Claims, 17 Drawing Sheets

(56) References Cited

U.S. PATENT DOCUMENTS

| | | | | |
|---|---|---|---|---|
| 6,637,815 | B1 * | 10/2003 | Louque | A47C 7/66<br>114/361 |
| 6,659,551 | B1 * | 12/2003 | Arenas | B60N 2/6027<br>160/23.1 |
| 6,709,054 | B2 * | 3/2004 | Riley | A47C 31/11<br>297/218.1 |
| 7,690,725 | B1 * | 4/2010 | Rawlings | A47C 7/62<br>297/229 |
| 9,327,629 | B2 * | 5/2016 | Huebner | B60N 2/60 |
| 9,815,395 | B2 * | 11/2017 | Umlauf | B60N 2/90 |
| 9,867,409 | B1 * | 1/2018 | Mroz | A41D 15/04 |
| 2008/0284217 | A1 * | 11/2008 | Noonan | A47C 7/66<br>297/184.11 |
| 2019/0039486 | A1 * | 2/2019 | Wright | B60N 2/6009 |

* cited by examiner
† cited by third party

PROTECTIVE COVER FOR OUTDOOR APPARATUS

CROSS REFERENCE TO RELATED APPLICATIONS

This application claims priority to International Application No. PCT/US19/32299 entitled "PROTECTIVE COVER FOR OUTDOOR APPARATUS," and filed on May 14, 2019, which in turn claims priority under 35 U.S.C. § 119 to U.S. Provisional Application No. 62/671,347, entitled "Outdoor Apparatus and Integrated Protective Cover," and filed on May 14, 2018. The contents of these applications are hereby incorporated by reference in their entirety.

FIELD

The present disclosure relates to a protective cover for a chair.

BACKGROUND

Consumer demand for outdoor furniture is at an all-time high. Outdoor furniture is a $9 billion dollar per year business in the US and is one of the fastest growing categories in the furniture market. 92% of all new single-family homes built in the US in 2017 have a patio, porch, or deck. An "outdoor living room" is a highly requested specialty room, surpassing the home office for the past six consecutive years, according to the American Institute of Architects.

Outdoor furniture is subject to environmental conditions that are much more extreme than most other furniture. These conditions include hot and cold temperatures, cycling between extreme temperatures, humidity, extremely dry air, rain, snow, sleet and other precipitation, ice, wind, UV exposure from the sun, environmental pollutants, salt, chlorine and other swimming pool chemicals, and a myriad of other environmental contaminants. Furthermore, outdoor furniture comes in contact with all types of substances that have the potential to dirty, stain, or degrade the materials of construction, including dirt, leaves, sap, pollen, and other debris from plants, bird droppings, mold, mildew, and other fungi, bacteria, pet hair, food and beverages, natural skin oils, sunscreen, body lotion, makeup, and more. To add to the challenge, these conditions vary drastically throughout different parts of the United States, throughout different countries, and across seasons. Conventional outdoor furniture is not designed for certain geographies or seasonal periods; nevertheless, conventional outdoor furniture products are used in all conditions.

To meet the requirements necessary to withstand such a wide range of harsh conditions, some conventional outdoor furniture is made from very durable materials. This durability often correlates with hard, stiff, and heavy material properties; and such materials are often high in cost. In contrast to the design of conventional furniture, customers prefer comfortable and usable products that are not too costly. Therefore, the environmental performance requirements and customer demands are often in conflict.

To balance these conflicts, traditional furniture designers take one of two approaches. The first approach is to design products that are strong, sturdy, hard, and do not absorb water. An example is a chair made entirely of aluminum. Made from a strong, lightweight, non-absorbent and relatively inert (corrosion resistant) material, an aluminum chair can withstand many seasons outside. This approach suffers from a lack of comfort and can be limited aesthetically.

The second approach is to design products that use soft, comfortable materials which require covers to protect the materials from the elements. An example of this is an outdoor sofa with foam cushions and fabric cushion covers that requires a large "rain cover" to be placed over the furniture between uses, in order to ensure the product survives many seasons. This approach requires much more user effort to maintain the furniture. Rain covers are large and bulky; they require a place for storage, and time and effort to cover the furniture after each time it is used. The covers can get wet, dirty, and often require two people to cover the furniture. Because of these inconveniences, owners of outdoor furniture frequently describe the use of a rain cover as among the most frustrating and disliked aspects of ownership (even though the use of a rain cover is often limited to just a few times per season). However, not using a rain cover dramatically reduces the lifetime of these products and makes their limited use much less enjoyable, as owners are left with wet, dirty, and often moldy furniture. This inconvenience of using a rain cover, or the lack of a cover, leads many owners to store the entire furniture or components of the furniture, such as cushions and pillows, between uses. Storage occupies valuable space in the garage, shed, cover patio, or other living spaces. Dirty stacked cushions are unsightly. And transporting the furniture or components to and from storage takes time, effort (usually multiple trips), and is unpleasant when the products are wet or dirty.

Neither of the existing design approaches results in satisfied customers. For this reason, owners of outdoor furniture frequently describe dissatisfaction with, and ultimately limit their use of, the furniture and their enjoyment of outdoor spaces.

SUMMARY

The various examples of the present disclosure are directed towards a protective covering, which includes a cover portion, an elongated piece of fabric, a first coupling mechanism, and a second coupling mechanism. The cover portion is for a seat cushion. The elongated piece of fabric extends from the cover portion. The first coupling mechanism couples the cover portion to a first end of the elongated piece of fabric. The second coupling mechanism is configured to couple the cover portion to a second end of the elongated piece of fabric.

In some examples, the first coupling mechanism includes any of: male and female connectors, hook and loop fasteners, Velcro, an adhesive element, sewn seams, and a zipper.

In some examples, the protective cover further includes a handle, which is proximally located to the second end of the elongated piece of fabric.

In some examples, the second coupling mechanism includes a ferromagnetic rod affixed to the second end of the elongated piece of fabric. The second coupling mechanism further includes at least one magnet affixed to the cover portion. The magnet is located on the cover portion, corresponding to a location of the rod when the elongated piece of fabric is wrapped in a first direction around the cover portion.

In some examples, the magnet and the rod provide a magnetic force stronger than a gravitational weight of the cover portion, the cushion, and a second cushion.

In some examples, the cover portion is configured to receive a cushion.

In some examples, a length of the elongated cover is sufficient to wrap around both the cover portion when the cover portion has received the cushion and a second cushion.

In some examples, the protective cover includes weather resistant synthetic material.

In some examples, the first coupling mechanism includes a zipper, and the second coupling mechanism includes Velcro.

Another embodiment of the present disclosure provides for a chair system, which includes a chair with a back portion and a seat portion; a seat cushion; a back cushion; and a protective covering. The protective covering can be as described above.

In some examples, the first coupling mechanism comprises a zipper, and wherein the second coupling mechanism comprises Velcro.

In some examples, the second coupling mechanism includes a rod at the second end of the elongated piece of fabric and at least one magnet at the second end of the cover.

In some examples, the magnet and the rod provide a magnetic force stronger than a gravitational weight of the cover portion, the cushion, and a second cushion.

In some examples, the cover portion is configured to receive a first cushion.

In some examples, a length of the elongated cover is sufficient to wrap around both a second cushion and the cover portion when the cover portion has received the first cushion.

In some examples, the first coupling mechanism comprises at least one of: male and female connectors, hook and loop fasteners, Velcro, an adhesive element, sewn seams, and a zipper.

In some examples, the protective covering includes a handle, which is proximally located to the second end of the elongated piece of fabric.

In some examples, the cover portion includes at least one magnet corresponding to a location of the rod when the elongated piece of fabric is wrapped in a first direction around the cover portion.

In some examples, the protective cover includes weather resistant synthetic material.

In some examples, the protective cover and the back portion are further configured to removably couple with a third coupling mechanism.

The above summary is not intended to represent each embodiment or every aspect of the present disclosure. Rather, the foregoing summary merely provides an example of some of the novel aspects and features set forth herein. The above features and advantages, and other features and advantages of the present disclosure, will be readily apparent from the following detailed description of representative embodiments and modes for carrying out the present invention, when taken in connection with the accompanying drawings and the appended claims.

BRIEF DESCRIPTION OF THE DRAWINGS

The accompanying drawings exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

DETAILED DESCRIPTION

Figure 1A:
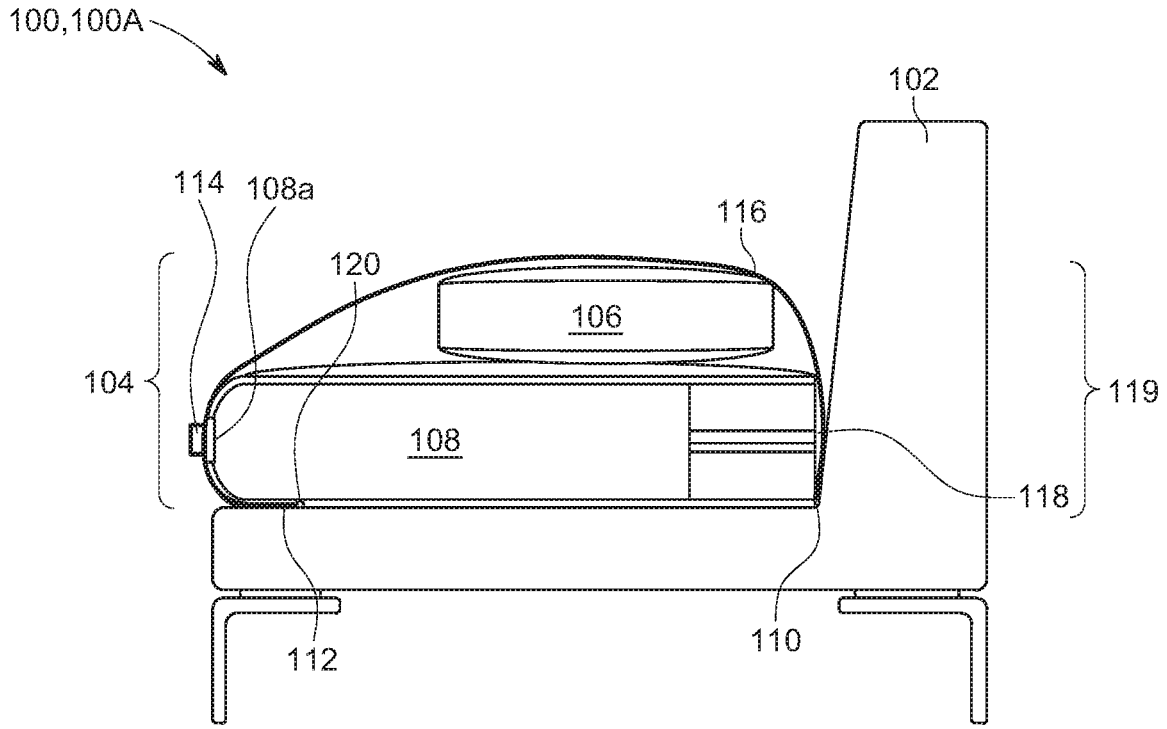
FIG. 1A shows an exemplary chair and cover apparatus secured in a first position, according to an embodiment of the present disclosure.

The present invention is described with reference to the attached figures, where like reference numerals are used throughout the figures to designate similar or equivalent elements. The figures are not drawn to scale, and are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details, or with other methods. In other instances, well-known structures or operations are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

The present disclosure is directed to outdoor furniture apparatuses which provide comfort, durability, cleanliness, maintenance, and convenience. An exemplary apparatus of the present disclosure provides an integrated zip on/zip off cover that allows the customer to cover outdoor furniture cushions quickly and easily from the elements. When in a covering configuration, the cover covers both back and seat cushions, and can be optionally secured to the bottom of a seat cushion via a hook and loop fastener. In some examples, the cover hangs over the front the cushions. In some examples, the cover is secured in its hanging position to the front of the furniture with magnets. When not in use, the cover can be stowed behind the back cushion where it is out of sight but easily accessible to quick deployment. In some examples, stowage behind the back cushion is done by (1) rolling the cover around a rigid internal member, (2) placing the rolled cover at the upper back edge of the seat cushion, and (3) replacing the back cushion. In some examples, the cover is hung over the back of the chair or sofa.

The present disclosure therefore provides a quick and simple method of protecting the cushions from the environment without the need for a separate rain cover. Therefore, the present disclosure provides systems and apparatuses for fast and easy protection of outdoor furniture cushions from the elements.

FIG. 1A shows an exemplary chair system 100 in a first position 100A, according to an embodiment of the present disclosure. Chair system 100 includes a chair 102, an integrated cover apparatus 104, a small cushion 106, a large cushion cover 108, a first attachment point 110, a second attachment point 112, a handle 114, an elongated piece of fabric 116, a receiving portion 118, and a third attachment point 120.

The integrated cover apparatus 104 is configured to be put on a chair 102. The integrated cover apparatus 104 includes a cover portion for the large cushion cover 108 and an elongated piece of fabric 116. The elongated piece of fabric 116 and the cover portion for the large cushion cover 108 can have various coupling mechanisms to couple the fabric 116 to the large cushion cover 108.

For example, a first coupling mechanism can be found at location 110, at a junction between a first end of the elongated piece of fabric 118 and a first end of the large cushion cover 108. In some examples, the first coupling mechanism is a permanent or semi-permanent attachment mechanism, including glue, tape, a sewn seam, or any other permanent or semi-permanent attachment mechanism as known in the art. In other examples, the coupling mechanism is a removable coupling mechanism, including male and female connectors, hook and loop fasteners, Velcro, an adhesive element, snaps, buttons, tongue-in groove, magnets, and a zipper. The removable coupling mechanism allows the elongated piece of fabric 118 and the large cushion cover 108 to be separated for storage and/or cleaning.

A second coupling mechanism includes a pair of mechanism at locations 112 and 120 and couples a second end of the elongated piece of fabric 116 to the large cushion cover 108. In some examples, the coupling mechanism includes a rod at location 112 on the elongated piece of fabric 116. The rod is made of a ferromagnetic material. In some examples, the rod is a steel rod spanning the entire width of the integrated cover 104 and sewn into the front edge of the elongated piece of fabric 116. The steel rod has a powder coated finish to prevent rusting. In other examples, the rod is made from plastic. In other examples, the rod is a flat plate or a plurality of small weights.

The second coupling mechanism further includes one or more magnets at location 120, on a bottom portion of the large cushion cover 108. In some examples, the magnets are embedded into an underside of the large cushion cover 108 and are parallel to a front edge 108*a*. Location 120 is located such that an end of the elongated piece of fabric 116 is directly adjacent to location 120, when the elongated piece of fabric has wrapped around the small cushion 106 and the large cushion cover 108. Therefore, this magnetic coupling mechanism allows convenient coupling between the elongated piece of fabric 116 and the large cushion cover 108 through automatic magnetic coupling.

In other examples, the second coupling mechanism is any removable coupling mechanism as known in the art, including male and female connectors, hook and loop fasteners, Velcro, an adhesive element, snaps, buttons, tongue-in groove, magnets, and a zipper.

The large cushion cover 108 receives a cushion, for example, through a zipper along the receiving portion 118. The large cushion cover 108 can receive a seat cushion. The small cushion 106 can be a back seat cushion.

The elongated piece of fabric 116 is a length of fabric with dimensions that allow for full coverage of the width and depth of the large cushion cover 108 and small cushion 106. For example, a length from a first end (e.g., location 110) to a second end (e.g., location 112) of the elongated piece of fabric 116 is long enough to: (1) wrap over the small cushion 106 and the large cushion cover 108 (when a cushion has been received); (2) cover a front portion 108*a* of the large cushion cover 108; and (3) wrap under the large cushion cover 108 enough to secure the second end of the elongated piece of fabric 116 to coupling mechanism located on the large cushion cover 108 at location 120. In some examples, the elongated piece of fabric 116 is secured by simply a weight of small cushion 106 and a cushion housed in cover 108.

Figure 5:
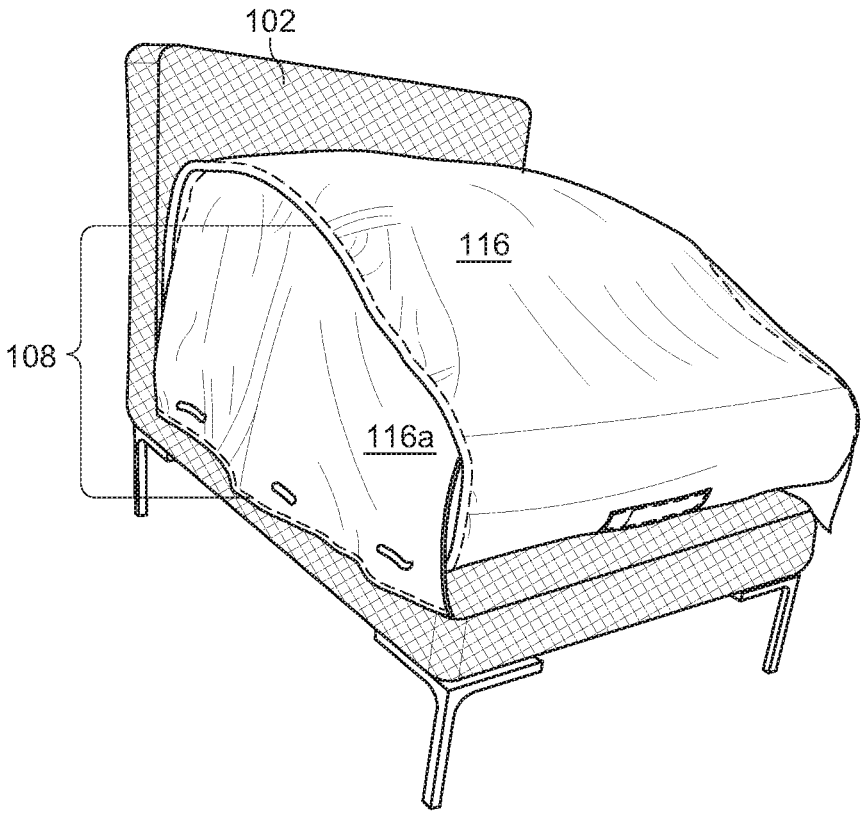
FIG. 5 shows an integrated cover apparatus with side portions.

In some examples, a width of the elongated piece of fabric 116 is wider than a width of the large cushion cover 108 and a height 108 of the large cushion cover 108 and the small cushion 106. Referring momentarily to FIG. 5, the elongated piece of fabric 116 covers the entirety of cushions 106 and 108 to protect the cushions 106 and 108. For example, the elongated piece of fabric 116 includes side panels 116*a*, which have a length equal to a height 108 of the large cushion cover 108 and the small cushion 106.

In some examples, the elongated piece of fabric 116 and the large cushion cover 108 have a coating that is water resistant and highly stain resistant. The small cushion 106 is made from the same fabric. In some examples, the fabric is a solution-dyed fabric that is fade resistant, mold resistant, and mildew resistant. In some example, the fabric is woven from recyclable, solution-dyed olefin polymer yarn; this yarn resists fading from UV exposure and is wear resistant, stain resistant, mold resistant and mildew resistant. In other examples, the fabric includes decorative designs, or contains text/graphic instructions, or other visual cues to enhance user experience. In some examples, lower cost materials are used for the fabric that are not recyclable or as resistant to fading, wear, and/or staining. In some examples, the fabric is made from synthetic materials including any of acrylic, polyester, nylon, and any combination thereof.

In some examples, a bottom portion of the large cushion cover 108 (i.e., the portion of the large cushion cover 108 which directly abuts chair 102) is coated with a waterproof material, such as polyurethane or rubber.

Therefore, FIG. 1A demonstrates how the integrated cover apparatus 104 provides a protective barrier to a back cushion (e.g., cushion 108) and a seat cushion (e.g., cushion 106), thereby extending the lifespan of the cushions. The elongated piece of fabric 116 in particular, offers a lower cost alternative to replacing the entire cushion or cushion cover 108. By simply unzipping and replacing the elongated piece of fabric 116, a user has cost-effective alternative to replacing the integrated cover 104.

Figure 1B:
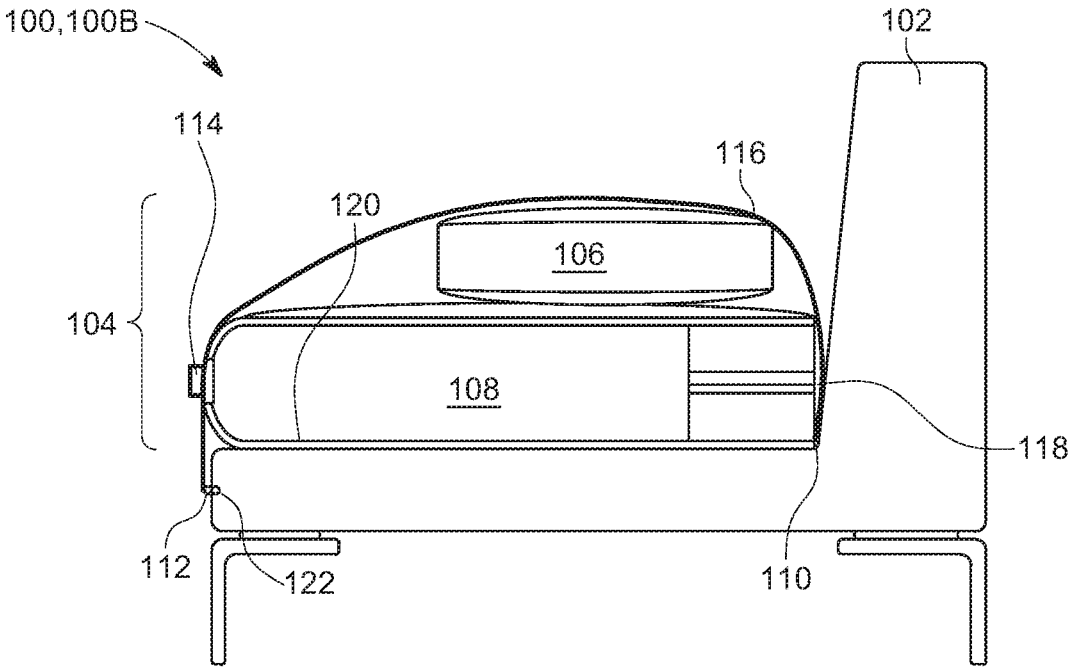
FIG. 1B shows an exemplary chair and cover apparatus secured in a second position, according to an embodiment of the present disclosure.

FIG. 1B shows the exemplary system 100 of FIG. 1A secured in a second position 100B, according to an embodiment of the present disclosure. FIG. 1B includes similar components and identical labels to FIG. 1A. In addition, FIG. 1B shows magnets 122 along a front edge of the chair 102. In some examples, the chair 102 includes a rail along a width of the chair, and the rail includes a plurality of magnets configured to couple with a rod along a first edge 112 of the elongated piece of fabric 116. FIG. 1B shows a secured position 100B where a user simply drapes the elongated piece of fabric 116 over the small cushion 106 and the large cushion cover 108, where the elongated piece of fabric 116 is automatically secured due to a magnetic connection without the user needing to manually secure the cover. A rod along a width of the front edge 112 of the elongated piece of fabric 116 further keeps the elongated piece of fabric 116 flattened (i.e., not folded over) for ease of automatic magnetic connection.

Therefore, FIGS. 1A-1B provide a chair and cover apparatus with a convenient, low effort way to protect the furniture from the environment by securing the elongated piece of fabric over the cushions. The elongated piece of fabric 116 protects the small cushion 106 and large cushion cover 108 from light rain, morning dew, dust, sand, pollen, bird droppings, UV rays, and any other environmental elements. The elongated piece of fabric 116 provides light duty protection from these elements, and additionally reduces the time needed to cover patio furniture. Accordingly, the furniture remains clean, dry, and quickly ready to use for many seasons.

Figure 2A:
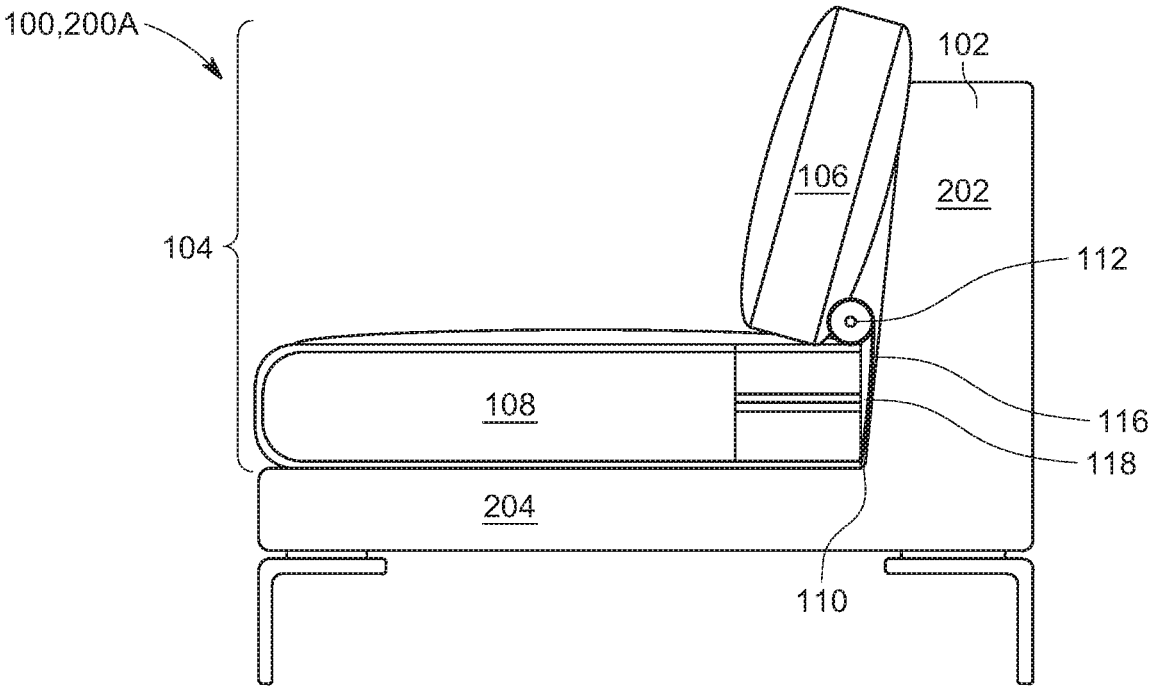
FIG. 2A shows an exemplary chair and cover apparatus in a first user configuration, according to an embodiment of the present disclosure.

FIG. 2A shows a side view of system 100 in a first user configuration 200A, according to an embodiment of the present disclosure. FIG. 2A includes similar components and identical labels to FIG. 1A. FIG. 2A further shows a back rest 202 of the chair 102 and a seat portion 204 of the chair 102. In configuration 200A, the small cushion 106 is positioned against the back rest 202. The elongated piece of fabric 116 is curled around a rod at location 112 and position behind the small cushion 106. Therefore, in configuration 200A, the user can sit on the chair 102 without interference from the elongated piece of fabric 116. Additionally, neatly storing the elongated piece of fabric 102 behind the small cushion 106 provides an aesthetically pleasing appearance.

In some examples, the elongated piece of fabric 116 is configured to automatically retract into configuration 200A when the elongated piece of fabric 116 is not coupled in another position (for example, coupled at locations 122 or 120, as shown in FIGS. 1A and 1B, respectively). For example, the elongated piece of fabric 116 automatically retracts via a spring mechanism.

Figure 2B:
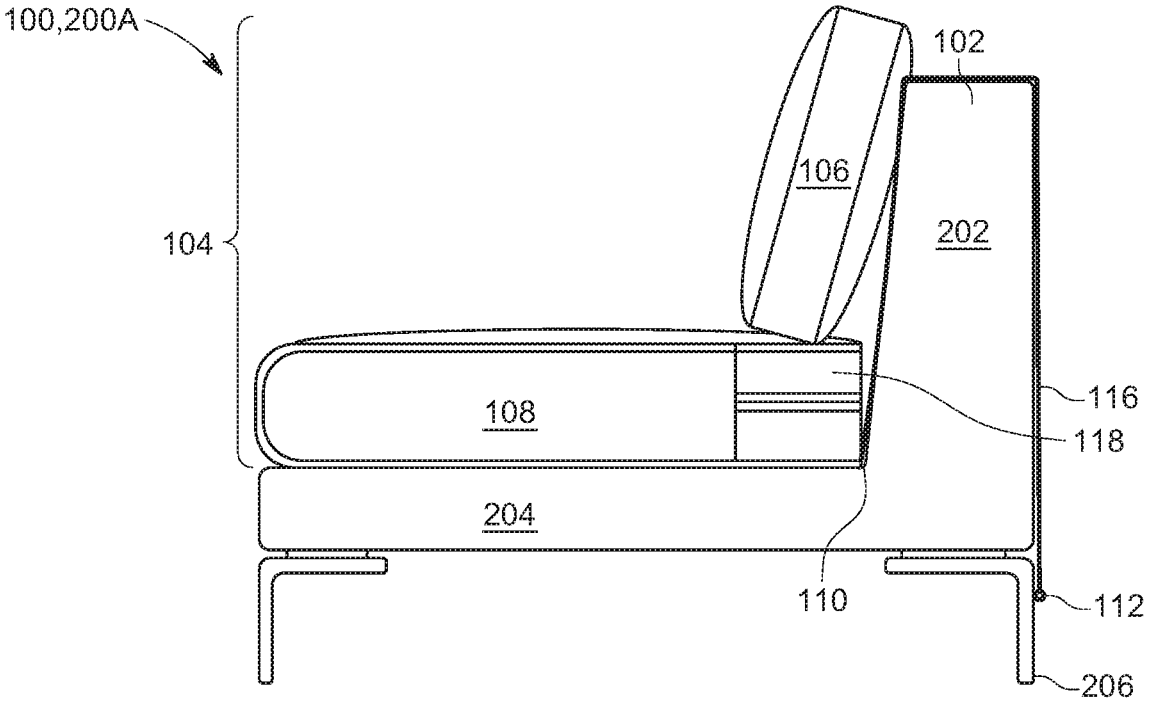
FIG. 2B shows an exemplary chair and cover apparatus in a second user configuration, according to an embodiment of the present disclosure.

FIG. 2B shows a side view of system 100 in a second user configuration 200B, according to an embodiment of the present disclosure. FIG. 2B includes similar components and identical labels to FIG. 2A. In configuration 200B, the elongated piece of fabric 116 is shown fully extended over the back rest 202 of the chair 102. In some examples, the rod 112 acts as a weight to keep the elongated piece of fabric 116 weighed down in configuration 200B. A length of the elongated piece of fabric 116 between location 110 and 112 is short enough so that a front edge 112 of the elongated piece of fabric does not reach an end portion 206 of the chair 102.

Figure 3A:
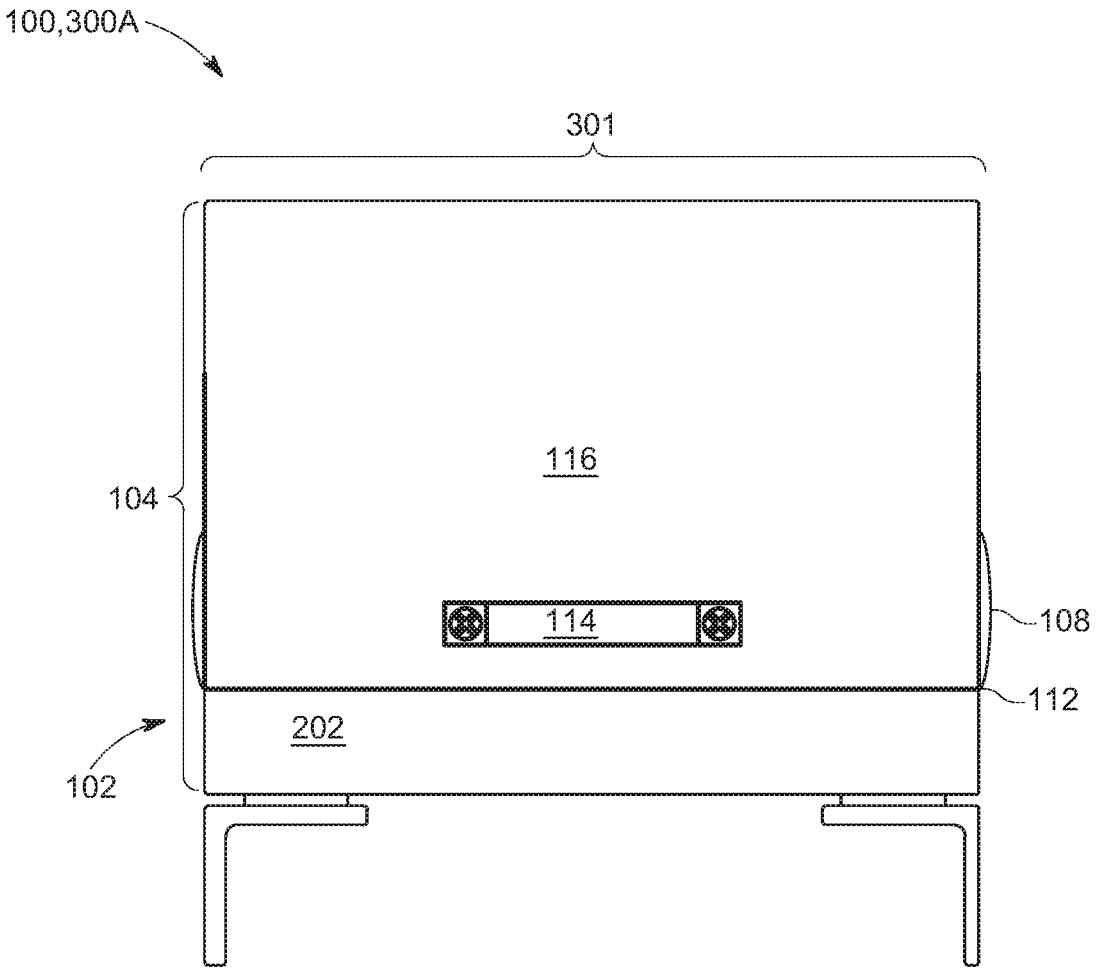
FIG. 3A shows a rear view of an exemplary chair and cover apparatus, according to an embodiment of the present disclosure.

FIG. 3A shows a rear view of system 100 in configuration 300A, according to an embodiment of the present disclosure. FIG. 3A includes similar components and identical labels to FIGS. 2A-2B. In some examples, configuration 300A shows a rear view of configuration 200B of FIG. 2B. FIG. 3A shows a full width 301 of the elongated piece of fabric 116. Configuration 300A demonstrates a position where the elongated piece of fabric 116 is wrapped around a backrest 202 of the chair 102. For example, a user can sit on a front portion of the chair (as shown in FIGS. 2A-2B). Furthermore, a rod at location 112, according to embodiments discussed above, provides a weight for the elongated piece of fabric 116 to further secure the elongated piece of fabric 116 in configuration 300A.

Figure 3B:
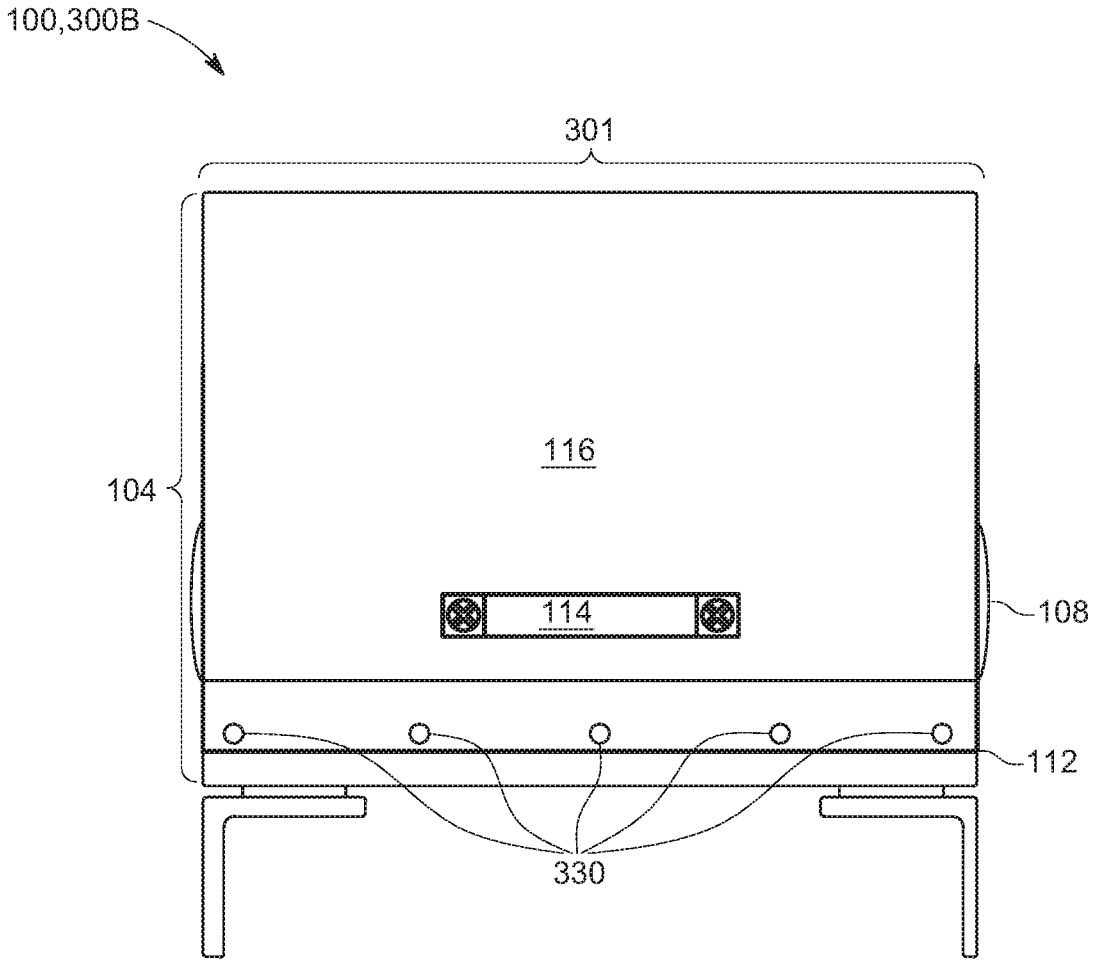
FIG. 3B shows another rear view of an exemplary chair and cover apparatus, according to an embodiment of the present disclosure.

FIG. 3B shows another rear view of system 100 in configuration 300B, according to an embodiment of the present disclosure. FIG. 3B includes similar components and identical labels to FIGS. 2A-2B. In some examples, configuration 300B shows a rear view of configuration 200B of FIG. 2B. FIG. 3B further shows a plurality of coupling mechanisms 330 along a bottom edge 112 of the elongated piece of fabric 116. These coupling mechanisms 330 couple with corresponding elements on the back rest 202 (not shown). In some examples, these coupling mechanisms 330 are magnets which couple with another magnetic element along the back rest 202. In other examples, these coupling mechanisms 330 are any removable coupling mechanism as known in the art, including male and female connectors, hook and loop fasteners, Velcro, an adhesive element, snaps, buttons, tongue-in groove, and a zipper.

Figure 4:
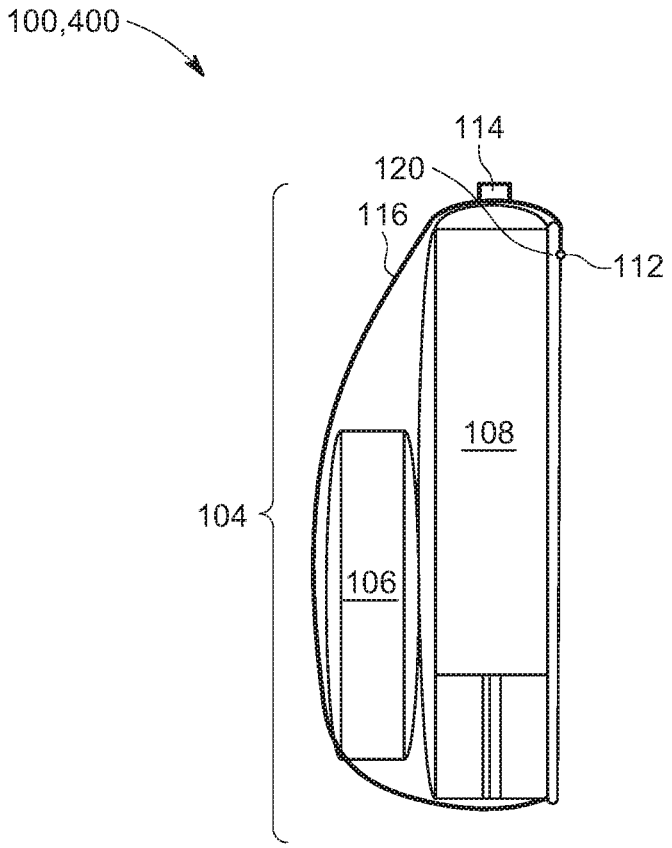
FIG. 4 shows an exemplary cover apparatus in a carrying configuration, according to an embodiment of the present disclosure.

FIG. 4 shows system 100 in a carrying configuration 400, according to an embodiment of the present disclosure. FIG. 4 includes similar components and identical labels to FIGS. 1A-1B. Configuration 400 corresponds to position 100A of FIG. 1A, where an end portion 112 of the elongated piece of fabric 116 is coupled with the large cushion cover 108 at location 120. Thereby, the integrated cover 104 can be carried by a user by handle 114. In configuration 400, the orientation of the cushions 106 and 108 is vertical to allow for carrying more than one set of cushions.

In some examples, the handle 114 is made from the same fabric as the elongated piece of fabric 116. In other examples, the handle 114 is made from webbing, plastic, or another material. In some examples, the handle is a rigid component, which could have additional features built in. In other examples, the handle is laminated or adhered to the elongated piece of fabric 114.

Therefore, configuration 400 shows how the integrated cover 104 can be used as a carrying case so that users can easily carry the cushions 106 and 108, thereby minimizing the number of trips to and from the storage location when the user needs to store multiple integrated cover 104. Configuration 400 further shows that during storage, the elongated piece of fabric 116 protects the small cushion 106 and the large cushion cover 108 from getting dirty. Configuration 400 additionally helps keep a plurality of systems 100 organized in a neat and uniform way. In some examples, the integrated cover 104 is hung by the handle 114.

Although particular chair apparatuses are shown in FIGS. 1A-5 as discussed above, the present disclosure contemplates that the integrated cover 104 can be used and readily adapted to any chair apparatus, as would be readily apparent to one skilled in the art. For example, the integrated cover 104 can have dimensions adapted for exterior furniture, interior furniture, futons, sofas, loveseats, lounge chairs, and any other seating apparatus.

Chaise Sectional Component

Figure 6A:
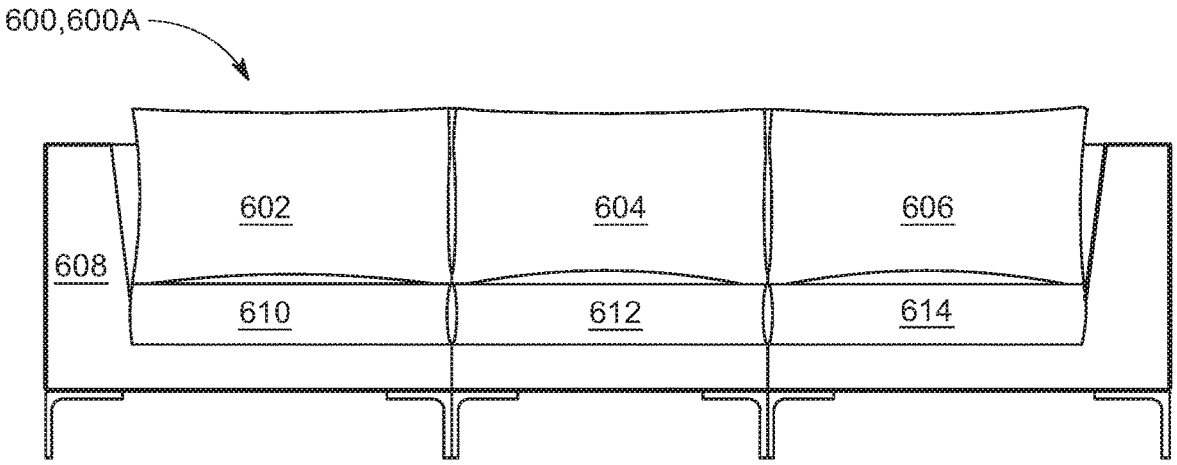
FIG. 6A shows an exemplary sectional chair system in a first user configuration, according to an embodiment of the present disclosure.
Figure 6B:
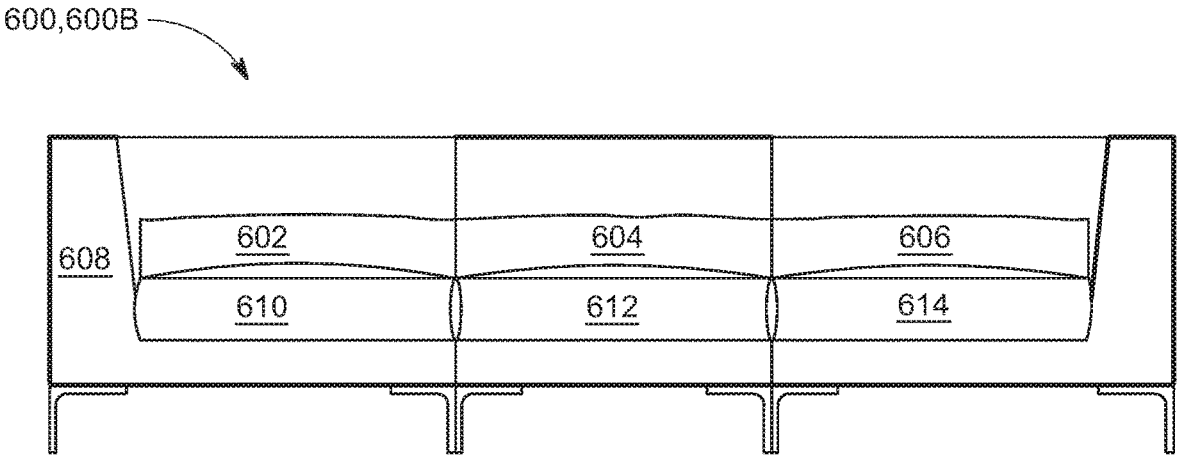
FIG. 6B shows an exemplary sectional chair system in an intermediate storage configuration, according to an embodiment of the present disclosure.
Figure 6C:
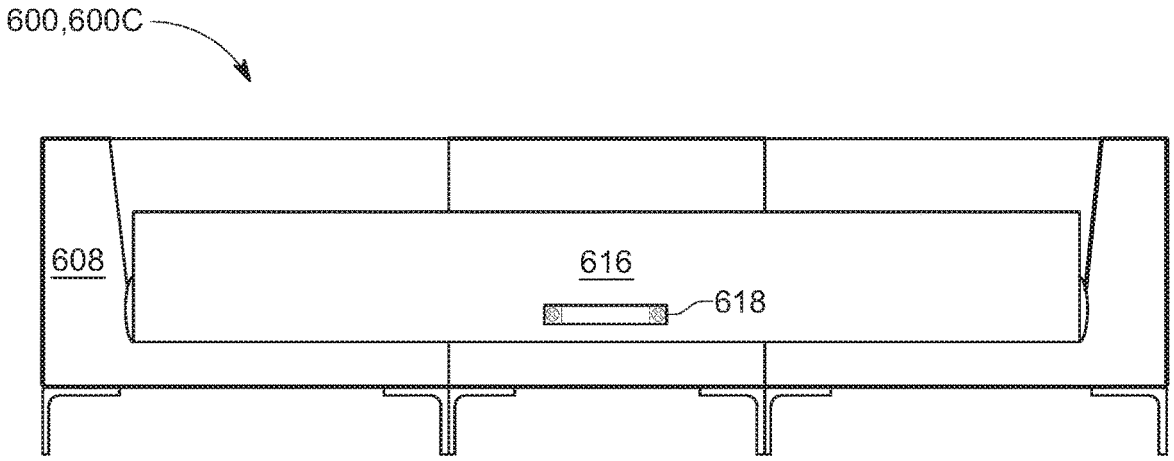
FIG. 6C shows an exemplary sectional chair system in a storage configuration, according to an embodiment of the present disclosure.

FIGS. 6A-6C show an exemplary sectional chair system 600, according to an embodiment of the present disclosure. Chair system 600 includes back cushions 602, 604, and 606; a chair frame 608; seat cushions 610, 612, and 614; a fabric cover 616; and a handle 618. As would be readily understood by one skilled in the art, the disclosed integrated cover can be adapted for a chair system with multiple back cushions 602, 604, 606 and seat cushions 610, 612, 614. Any examples and additional features of the chair systems shown in FIGS. 1A-5 can be provided for in system 600. FIG. 6A shows a position 600A where back cushions 602, 604, and 606 are propped against the chair frame 608, allowing user seating or lounging access to system 600. FIG. 6B shows an intermediate position 600B where back cushions 602, 604, and 606 lie against seat cushions 610, 612, and 614. FIG. 6C shows a covered position 600C where fabric cover 616 is extended over back cushions 602, 604, 606 and seat cushions 610, 612, 614.

Table Apparatus

FIGS. 7A-7D show an exemplary embodiment of a cover apparatus 700 for a table. FIGS. 7A-7D show various angles of a table system 700, including: (1) a top view 700A where the cover apparatus is not extended in FIG. 7A; (2) a side view 700B where the cover apparatus is not extended in FIG. 7B; (3) a side view 700C where the cover apparatus is extended in FIG. 7C; and (4) a lateral side view 700D where the cover apparatus is extended in FIG. 7D. As shown in FIGS. 7A-7D, system 700 includes a table 701 with a top 702 and a table opening 704; a cover housing 706; a cover portion 708; and a zipper 710.

The cover housing 706 attaches underneath the table top 702. The cover portion 708 is completely stored within cover housing 706.

Figure 7A:
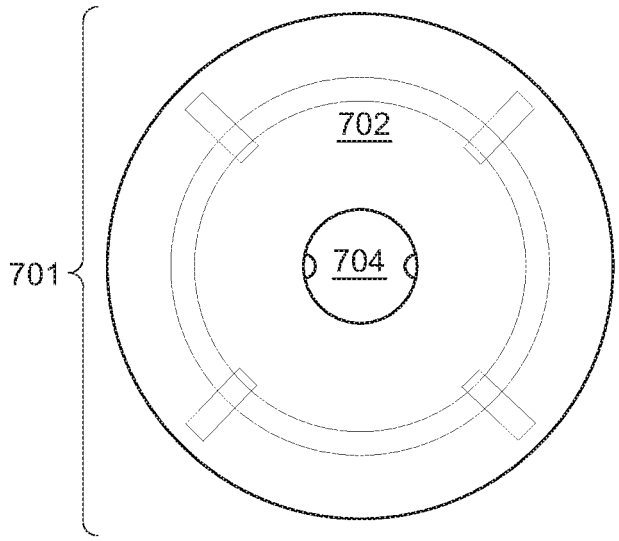
FIG. 7A shows a top view of an exemplary embodiment of a cover apparatus for a table, according to an embodiment of the present disclosure.
Figure 7B:
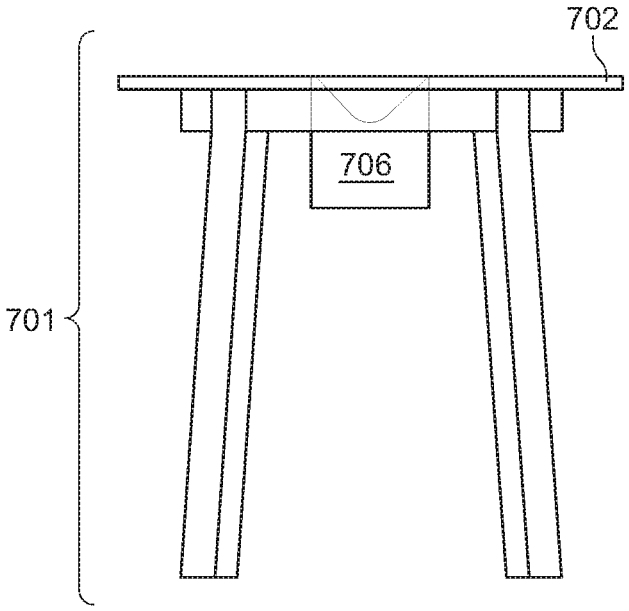
FIG. 7B shows a side view of the cover apparatus of FIG. 7A, according to an embodiment of the present disclosure.
Figure 7C:
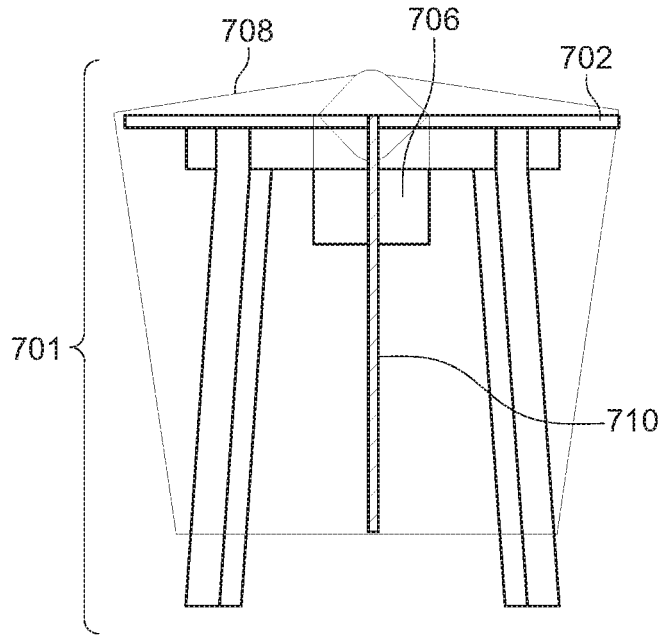
FIG. 7C shows a side view of the cover apparatus of FIG. 7A where the cover apparatus is extended, according to an embodiment of the present disclosure.
Figure 7D:
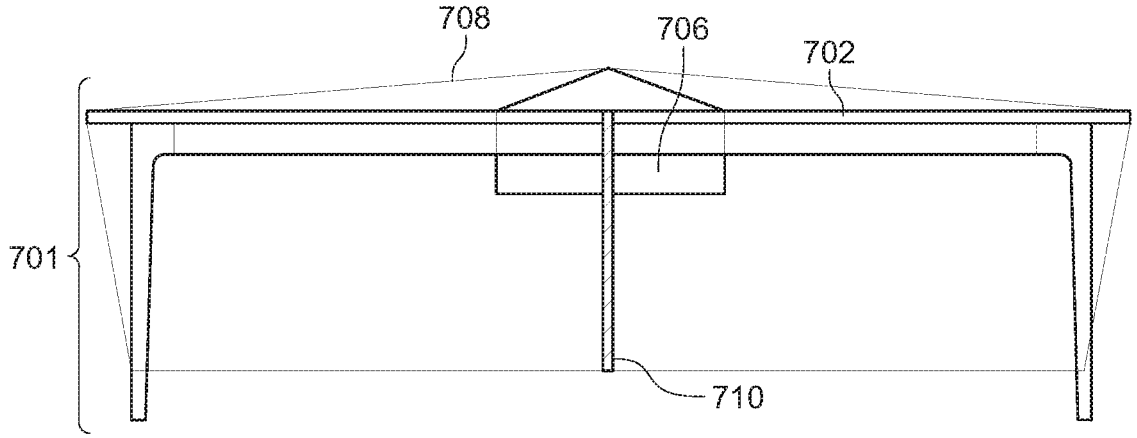
FIG. 7D shows another side view of the cover apparatus of FIG. 7A where the cover apparatus is extended, according to an embodiment of the present disclosure.

As shown in FIGS. 7C-7D, the cover portion 708 wraps over the table top 702 and can be zippered along zipper 710 to provide a secure cover.

In some examples, (not shown) the cover portion 708 attaches along the outside edge of the table top 702 to one of several places. In a first example, the cover portion 708 attaches underneath the table top 702 (similar to attaching under the chair cushion as shown in FIG. 1A). In another example, the cover portion 708 hooks to the edge of the table top 702 and has an elastic portion along an exterior edge of the cover portion 708 to maintain tension and keep the cover portion 708 in such a position. In another example, the cover portion 708 attaches at corners of the table 701 and tucks into pockets. An elastic portion along an edge of the cover portion 708 can further maintain tension and secure the cover portion 708 in such a position. In another example, the cover portion 708 does not attach to the table 701 and instead hangs with a weighted end. In another example, tension is provided to the cover portion 708 by adding weight to the cover close to the cover housing 706.

As shown in FIGS. 7C and 7D, the cover housing 706 can be inverted to provide an angled surface for the cover portion 708. Therefore, debris, water, pollen, dust, and ice can slide off the cover portion 708 due to the angling of the cover housing 706.

Figure 8A:
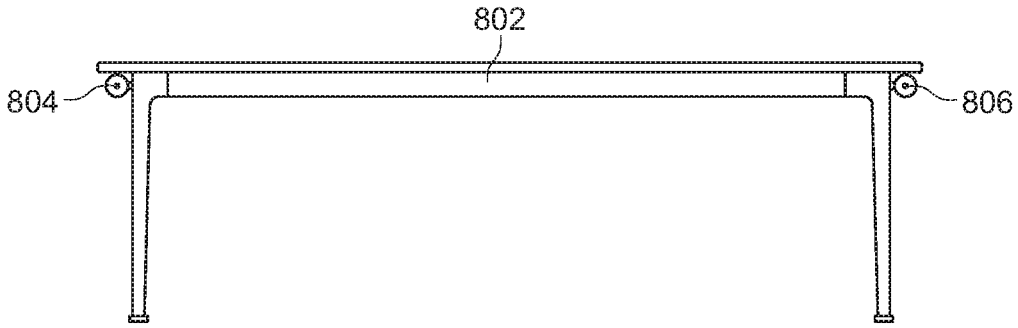
FIG. 8A shows another exemplary cover apparatus in a retracted position, according to an embodiment of the present disclosure.
Figure 8B:
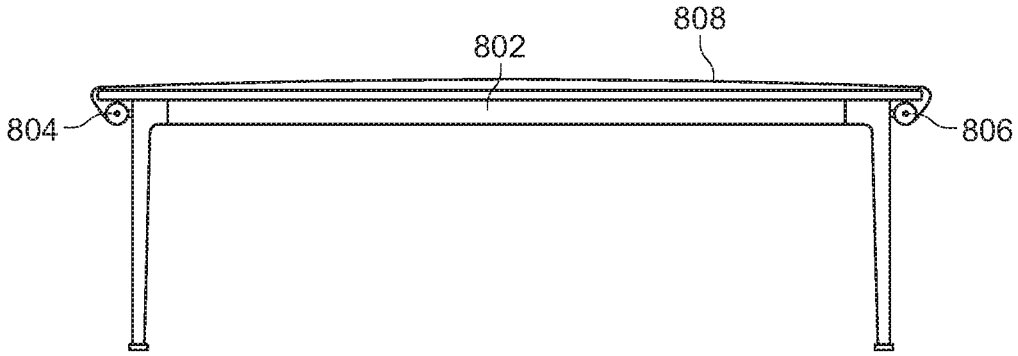
FIG. 8B shows the exemplary cover apparatus of FIG. 8A in an extended position, according to an embodiment of the present disclosure.

FIGS. 8A-8B show another exemplary cover apparatus 800, in a retracted position (800A of FIG. 8A) and an extended position (800B of FIG. 8B). Cover apparatus 800 includes a table 802, rollershade mechanisms 804 and 806, and a cover 808. In this embodiment, cover 808 extends over the table 802 from one rollershade mechanism 804 and attaches to another rollershade mechanism 806 at an opposite end of the table 802. In some examples, the cover 808 is on a spring-wound mechanism (e.g., like a window shade) which automatically stores in the rollershade mechanisms 804 and 806 when the cover 808 is not extended.

Users often prefer to keep a table surface clean, especially is the surface sensitive to the environmental conditions. The cover apparatuses as shown in FIGS. 7A-8B provide protection for the tables. Additional details and embodiments of the cover apparatuses can be as described above with respect to the cover apparatuses disclosed in FIGS. 1A-5. Although particular tables are shown in FIGS. 7A-8B, the present disclosure contemplates that a cover apparatus can be readily modified for any table.

Ottoman

Figure 9A:
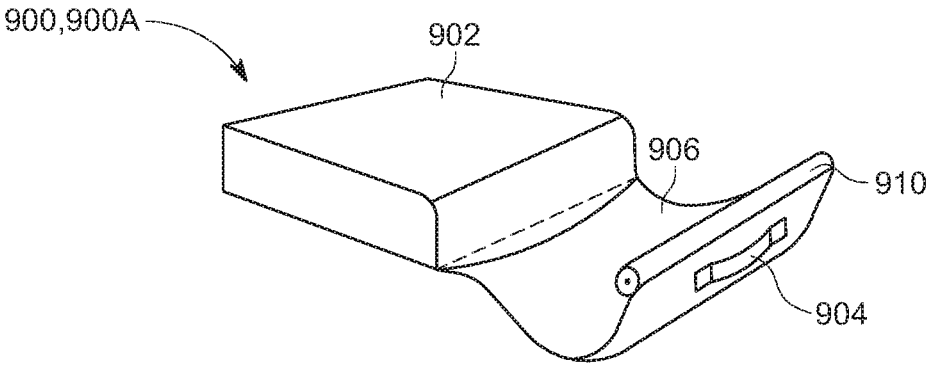
FIG. 9A shows an exemplary ottoman system, according to an embodiment of the present disclosure.
Figure 9B:
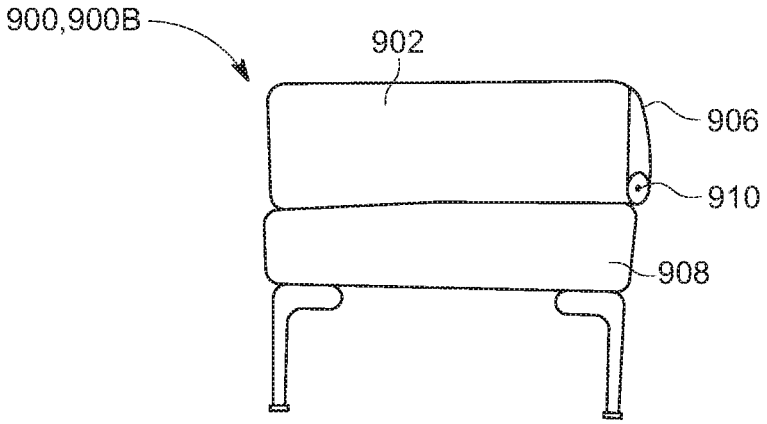
FIG. 9B shows the exemplary ottoman system of FIG. 9A where a cover portion is in an extended position, according to an embodiment of the present disclosure.
Figure 9C:
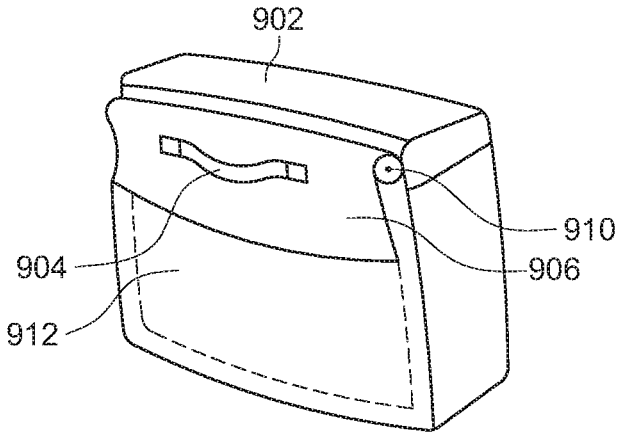
FIG. 9C shows the exemplary ottoman system of FIG. 9A where a cover portion is stored in a storage flap, according to an embodiment of the present disclosure.

FIGS. 9A-9C show an exemplary embodiment of the present disclosure as used for an ottoman system 900. Ottoman system 900 includes a cushion portion 902, handle 904, cover portion 906, ottoman body 908, rod 910, and storage flap 912. FIG. 9A shows a position 900A where the cushion portion 902 and cover portion 906 are separate from an ottoman body 908. FIG. 9B shows a position 900B where the cover portion 906 extends over the cushion portion 902. FIG. 9C shows a position 900C where the cover portion 906 is stored in the storage flap 912.

For example, the cover portion 906 is attached to the underside of the cushion portion 902. A user can lift cushion portion 902 to access stowed cover portion 906. A user can wrap around and secure the cover portion 906 to a bottom of an edge of the cushion portion, or simply hang the cover portion 906 over a side of the cushion portion 902 (as shown in FIG. 9B).

In some examples, of system 900 (not shown) the cover portion 906 is a two-piece cover that meets in the middle and fastens together with hook and loop (Velcro). For storage, the cushion portion 902 can be flipped over, then a first piece of the cover portion 906 can be laid flat and a second piece of the cover portion 906 can be laid over the first piece and secured with Velcro or removable coupling elements.

In some examples, as shown in FIG. 9C, the underside of the cushion portion 902 has a storage flap 912. The storage flap 912 can be configured as a pouch or storage pocket that the cover portion 906 tucks into when not in use. In another example of system 900 (not shown), a vertical panel (e.g., panel 902*a*) as a flap, pocket, or pouch, that the cover portion 906 tucks into when not in use.

Any additional examples of ottoman system 900 can include the characteristics and features as discussed above with respect to the chair systems of FIGS. 1A-5. For example, the rod 910 and the handle 904 can correspond to the rod and handle of chair systems of FIGS. 1A-5.

Poolside Lounge Chair

Figure 10A:
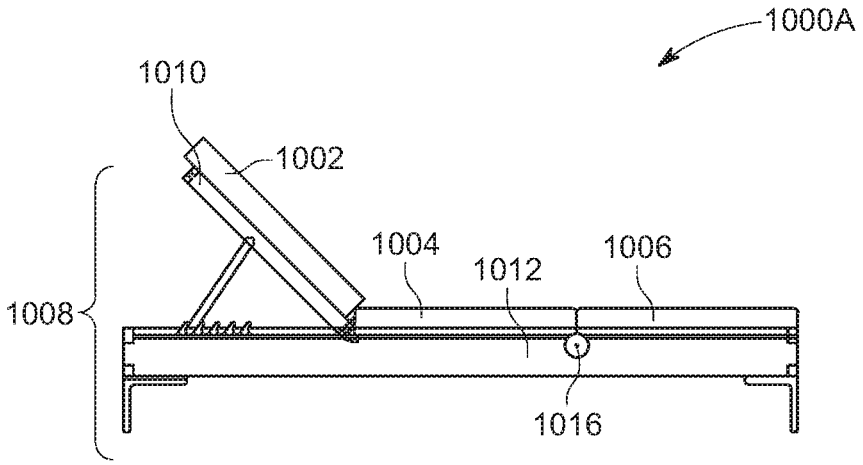
FIG. 10A shows an exemplary lounge chair cushion apparatus, according to an embodiment of the present disclosure.
Figure 10B:
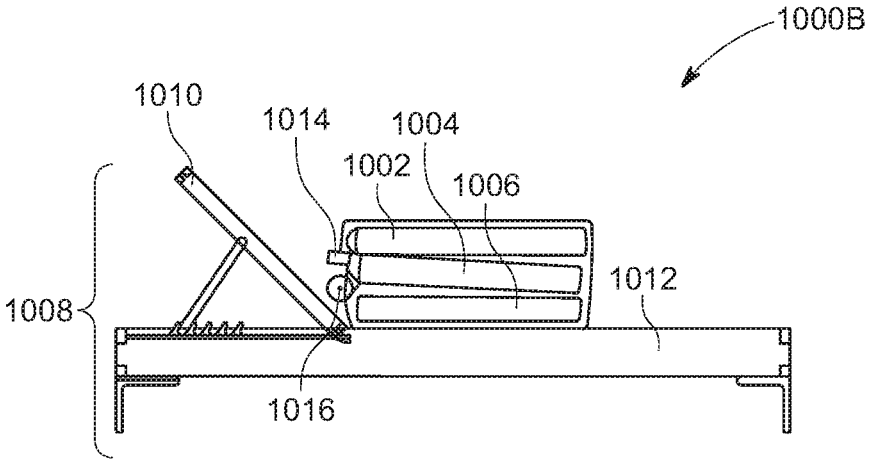
FIG. 10B shows the exemplary lounge chair cushion apparatus of FIG. 10A where the cushion is folded, according to an embodiment of the present disclosure.
Figure 10C:
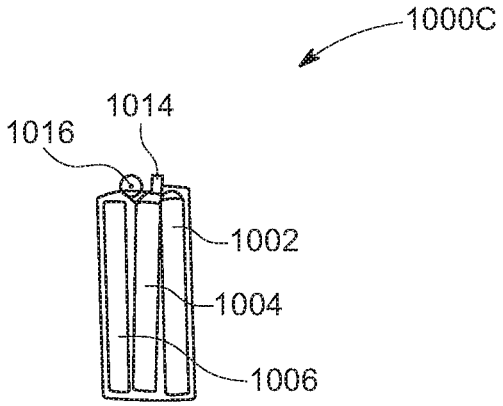
FIG. 10C shows the exemplary lounge chair cushion apparatus of FIG. 10A where the cushion is configured to be carried, according to an embodiment of the present disclosure.

FIGS. 10A-10C show an exemplary embodiment of the present disclosure where a cushion apparatus 1000 is provided for a lounge chair. For example, the lounge chair can be a pool chair. Apparatus 1000A includes a plurality of cushions 1002, 1004, and 1006; a chair 1008 with a back rest 1010 and a body portion 1012; a handle 1014; and a rolled fabric cover 1016.

FIG. 10A shows position 1000A where the cushion apparatus 1000 is fully extended along a chair 1008; FIG. 10B shows position 1000B where the cushion apparatus is folded into position 1000B; and FIG. 10C shows position 1000C where the cushion apparatus 1000 is configured to be carried by handle 1014.

The rolled fabric cover 1016 can be similar to the elongated piece of fabric 116, as discussed above. For example, the rolled fabric cover 1016 can be long enough to cover the entire chair. In some examples, the rolled fabric cover 1016 rolls up and stows in a pocket, or on hooks/shelves on the backside of the headrest area (not shown).

The cushions 1002, 1004, 1006 couple together with a mechanical coupling mechanism, including, for example, hook and loop, Velcro, zipper, male and female connectors, snaps, magnets, or a sewn seam. FIGS. 10B-10V show the cushions 1002, 1004, and 1006 in a folded format. In some examples, the rolled fabric cover 1016 is configured to unroll and complete cover an exterior portion of the cushions 1002, 1004, and 1006.

Cushion Storage System

Figure 11:
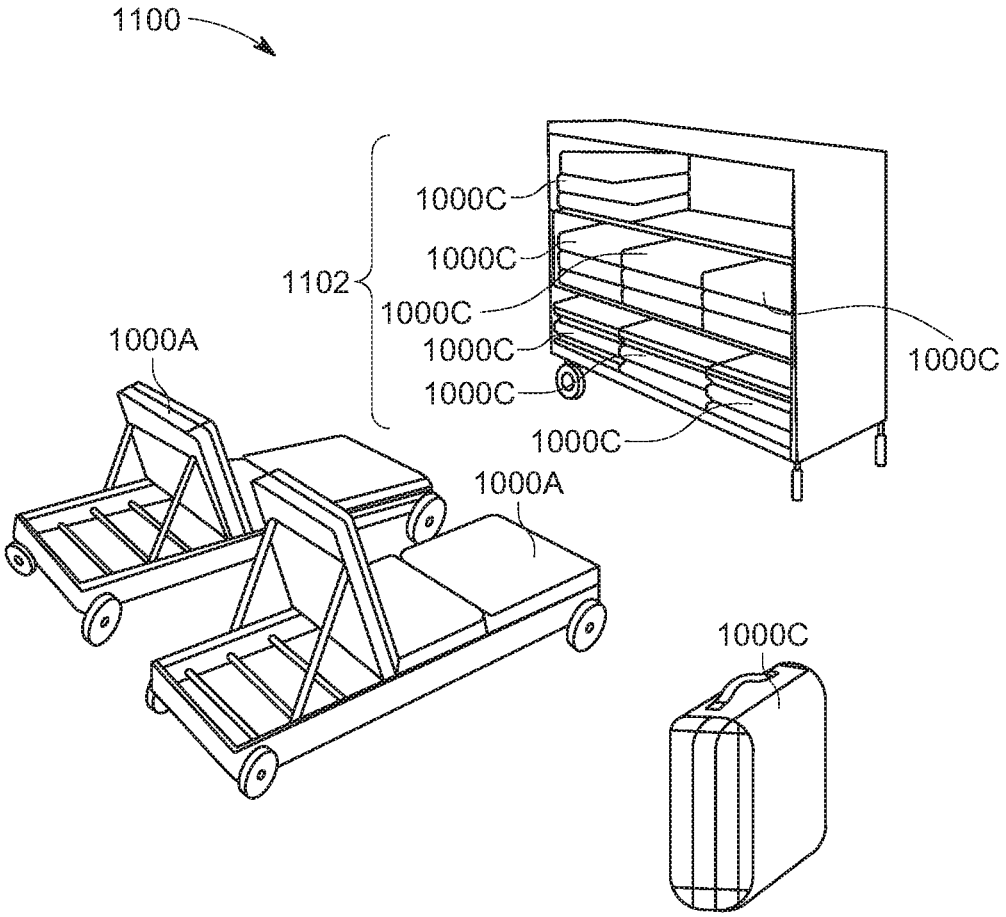
FIG. 11 shows an exemplary cushion storage system, according to an embodiment of the present disclosure.

The present disclosure further provides a cushion storage system 1100, as shown in FIG. 11. System 1100 includes some elements from FIGS. 10A-10C, including chair systems 1000A and 1000C. In addition, system 1100 includes storage container 1102.

System 1100 provides for the quick and easy set up and take down of furniture in hotel and resort settings, and reduces the amount of time needed by hotel staff to deploy and store cushions. Conventional resorts with pool or beachfront on their properties have hundreds of outdoor seating options for their guests. Each morning, the pool staff must set up each chair by putting the cushion on each chair. In the evenings, they must remove each cushion and store it securely for the next day's use. System 1100 improves the efficiency of setting up each chair and also incorporates the gathering and storage of the cushions into one transportable unit.

Storage container 1102 is a cushion storage unit on casters. As users set up each chair for the day, users remove a cushion set 1000C from the rolling storage unit 1102; open up the cushions that are enclosed by the integrated cover; and place the cushion on the seat to provide system 1000A. At the end of the day, users follow the reverse process. First, users use the disclosed integrated cover to fold up/pack up the cushions (1000C), and either hang the cushion on a rod or place it on a shelf in the storage container 1102.

Storage container 1102 includes wheels and can be rolled around to speed up the deployment and retrieval of the cushions. In addition, storage container 1102 can be used as a lockable storage unit.

Alternative Embodiments for Cover Apparatus

Figure 12:
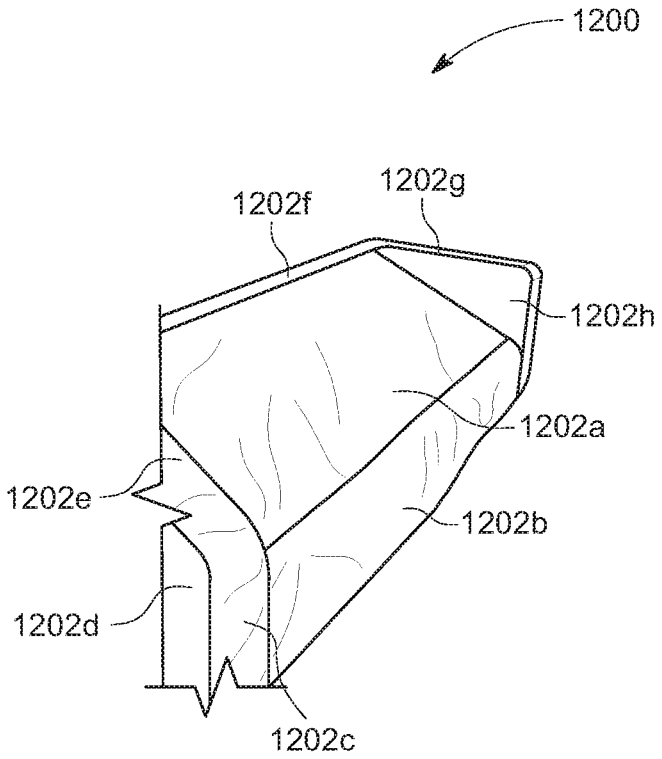
FIG. 12 shows an exemplary angled cushion cover, according to an embodiment of the present disclosure.

In some additional embodiments of the disclosed cover apparatus, a single cover spans the width of several cushions to provide protection for the cushions. Such an apparatus provides more complete protection than separate covers on each cushion because separate covers would include gaps between each cover. FIG. 12 shows an exemplary cover apparatus 1202 which covers an entire sofa. For example, the cover apparatus 1202 can be slanted along a middle portion 1204 so that water, dust, debris, pollen, and other external materials slide off the apparatus.

In some examples, the present disclosure contemplates several extra wide covers that overlap and optionally attach together to eliminate gaps between multiple covers.

Altogether, FIG. 12 demonstrates an angled weather cover. The cover can include a plurality of separate panels (e.g., panels 1202*a*, 1202*b*, 1202*c*, 1202*d*, 1202*e*, 1202*f*, 1202*g*, and 1202*h*) which are sewn together and prevent water from pooling. The cover 1202 provides a tight, tailored fit to a piece of furniture.

Some conventional furniture covers are made using a 5-panel fabric construction, including front, back left, right, and top panels. The present disclosure contemplates a unique 7 panel construction technique, including front, back, left, right, and top panels; and additionally, two wedge shaped panels that would form a water shedding angle to the top panel. These wedge-shaped panels provide a more tailored weather cover for furniture, and act as a design feature that helps rain to flow off of the weather cover.

The present disclosure further contemplates full rain cover with a zipper on one edge that makes the cover easy to align and secure. The zipper allows a user to orient the direction of the cushion using the unzipped edge and place it over the furniture. Once aligned, the cover can be zipped shut by pulling the zipper down. In some examples, the cover is slightly tapered to ensure a tighter fit as the cover is fully zipped closed.

Figure 13:
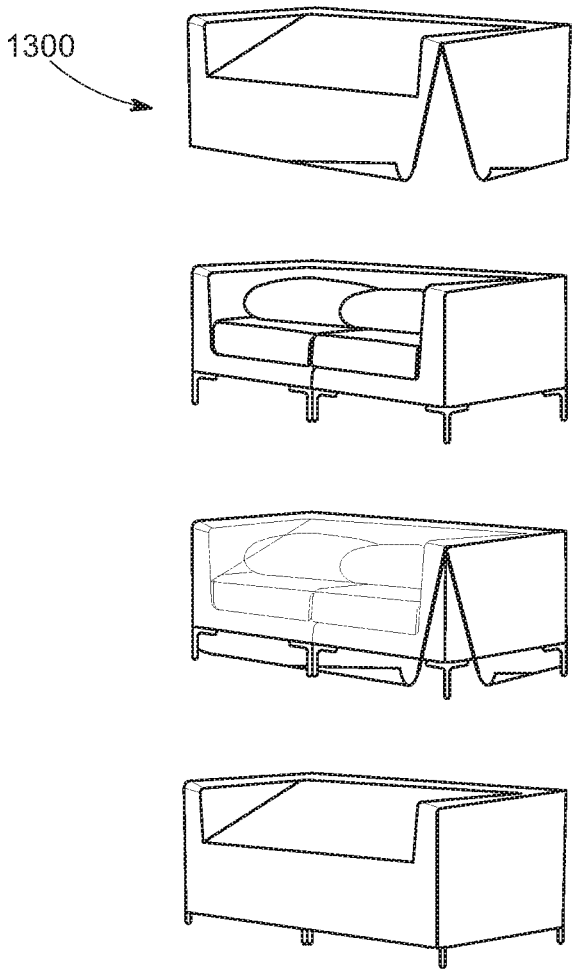
FIG. 13 shows an exemplary complete cover for an armchair, according to an embodiment of the present disclosure.

FIG. 13 shows an exemplary complete cover 1300 for an armchair, according to an embodiment of the present disclosure. In this example, the cover has one corner that has a waterproof zipper. This allows a user to orient the position of the cover 1300 and easily drape it over the furniture. Once the cover 1300 is in place, the user can zip the cover shut. In some examples, the cover 1300 is tapered from the top to the bottom which maintains a snug fit once zipped closed. This is to prevent updrafts on windy days to lift the rain cover off the furniture.

Figure 14A:
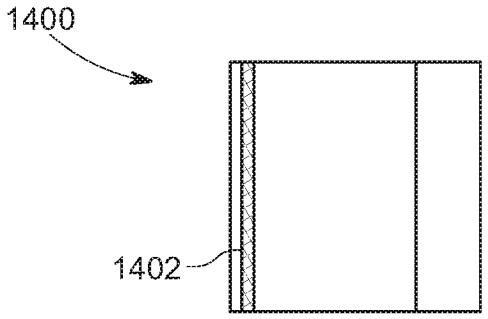
FIGS. 14A-14B show an exemplary ottoman cover, according to an embodiment of the present disclosure.
Figure 14B:
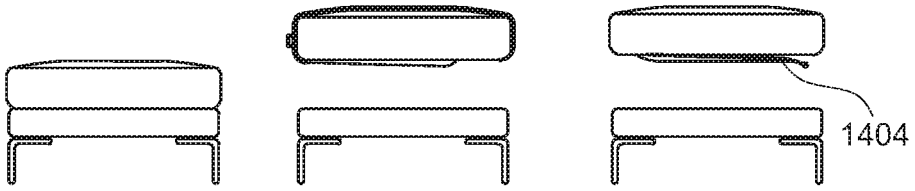

FIGS. 14A-14B show an exemplary ottoman cover 1400, according to an embodiment of the present disclosure. FIGS. 14A-14B include velcro 1402 along a surface of the ottoman cover, and a pocket 1404. In this example, a Velcro type strip secures the cover 1400 and allows a user to transport the cushion. The underside of the ottoman cushion can have a pouch that the cover 1400 can be tucked into when it is not deployed.

Figure 15:
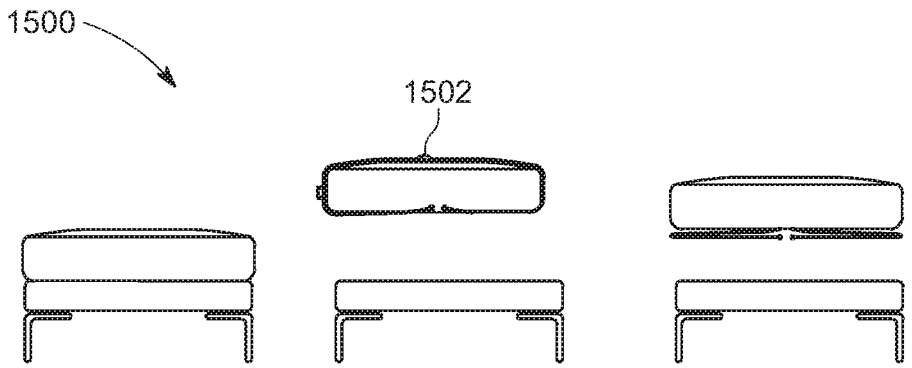
FIG. 15 shows another exemplary ottoman cover, according to an embodiment of the present disclosure.

FIG. 15 shows another exemplary ottoman cover 1500, according to an embodiment of the present disclosure. The ottoman of FIG. 15 includes an interlocking mechanism 1502 on the cushion cover. In this example, the cover 1500 is attached to the underside of the ottoman cushion. When deployed, the shell has an interlocking mechanism allowing the shell to be closed.

While various examples of the present invention have been described above, it should be understood that they have been presented by way of example only, and not limitation. Numerous changes to the disclosed examples can be made in accordance with the disclosure herein without departing from the spirit or scope of the invention. Thus, the breadth and scope of the present invention should not be limited by any of the above described examples. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

The terminology used herein is for the purpose of describing particular examples only and is not intended to be limiting of the invention. As used herein, the singular forms "a," "an," and "the" are intended to include the plural forms as well, unless the context clearly indicates otherwise. Furthermore, to the extent that the terms "including," "includes," "having," "has," "with," or variants thereof, are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. Furthermore, terms, such as those defined in commonly used dictionaries, should be interpreted as having a meaning that is consistent with their meaning in the context of the relevant art, and will not be interpreted in an idealized or overly formal sense unless expressly so defined herein.

What is claimed is:

1. A protective covering, comprising:

a cover portion for receiving a seat cushion therein, the cover portion having a depth defined between a front end and a rear end, the cover portion and the seat cushion together being removably positionable on a seating apparatus;

an elongated piece of fabric extending from the cover portion and movable between a covering position and a stowed position, the elongated piece of fabric having a first end and a second end, wherein the elongated piece of fabric is wrapped in a first direction over the cover portion and covers the depth of the cover portion when in the covering position; and a coupling mechanism configured to couple the cover portion to the first end of the elongated piece of fabric.

2. The protective covering of claim 1, wherein the coupling mechanism comprises at least one of: male and female connectors, hook and loop fasteners, an adhesive element, sewn seams, magnets, and a zipper.

3. The protective covering of claim 1, further comprising a handle, wherein the handle is proximally located to the second end of the elongated piece of fabric.

4. The protective covering of claim 1, further comprising:

a rod affixed to the second end of the elongated piece of fabric, the rod comprising a ferromagnetic material; and at least one magnet affixed to the cover portion, wherein the at least one magnet is located on the cover portion, corresponding to the rod, when the elongated piece of fabric is in the covering position.

5. The protective covering of claim 4, wherein the magnet and the rod provide a magnetic force stronger than a gravitational weight of the cover portion, the cushion, and a second cushion.

6. The protective covering of claim 1, wherein a length of the elongated piece of fabric is sufficient to wrap over both the cover portion and a second cushion when the elongated piece of fabric is in the covering position.

7. The protective covering of claim 1, wherein the protective cover comprises weather resistant synthetic material.

8. The protective covering of claim 1, further comprising an additional coupling mechanism configured to couple the cover portion to the second end of the elongated piece of fabric when the elongated piece of fabric is in the covering position.

9. The protective covering of claim 8, wherein the coupling mechanism comprises a zipper, and wherein the additional coupling mechanism comprises hook and loop fasteners.

10. The protective covering of claim 1, wherein the cover portion comprises a zipper through which the seat cushion is received.

11. A seating system, comprising:

a seating apparatus with a seat portion;

a seat cushion; and a protective covering, comprising:

a cover portion for receiving the seat cushion therein, the cover portion having a depth defined between a first end and a second end, the cover portion and the seat cushion together being removably positionable on the seating apparatus;

an elongated piece of fabric extending from the cover portion and movable between a covering position and a stowed position, the elongated piece of fabric having a first end and a second end, wherein the elongated piece of fabric is wrapped in a first direction over the cover portion and covers the depth of the cover portion when in the covering position;

a coupling mechanism configured to couple the first end of the cover portion to the first end of the elongated piece of fabric.

12. The seating system of claim 11, wherein the protective covering further comprises:

a rod affixed to the second end of the elongated piece of fabric, the rod comprising a ferromagnetic material; and and at least one magnet affixed to the cover portion, wherein the at least one magnet is located on the cover portion, corresponding to the rod, when the elongated piece of fabric is in the covering position.

13. The seating system of claim 12, wherein the magnet and the rod provide a magnetic force stronger than a gravitational weight of the cover portion, the cushion, and a second cushion.

14. The seating system of claim 11, wherein a length of the elongated piece of fabric is sufficient to wrap around both the cover portion and a second cushion when the elongated piece of fabric is in the covering position.

15. The seating system of claim 11, wherein the coupling mechanism comprises at least one of: male and female connectors, hook and loop fasteners, an adhesive element, sewn seams, and a zipper.

16. The seating system of claim 11, wherein the protective covering further comprises a handle, wherein the handle is proximally located to the second end of the elongated piece of fabric.

17. The seating system of claim 11, wherein the protective cover comprises weather resistant synthetic material.

18. The seating system of claim 11, wherein the protective covering further comprises an additional coupling mechanism configured to couple the cover portion to the second end of the elongated piece of fabric when the elongated piece of fabric is in the covering position.

19. The seating system of claim 18, wherein the coupling mechanism comprises a zipper, and wherein the additional coupling mechanism comprises hook and loop fasteners.

20. The seating system of claim 11, wherein the cover portion comprises a zipper through which the seat cushion is received.

* * * * *